United States Patent [19]

Schock

[11] 4,208,701

[45] Jun. 17, 1980

[54] LUMINOUS TOY

[76] Inventor: B. Dwain Schock, 15766 Via Colusa, San Lorenzo, Calif. 94580

[21] Appl. No.: 885,338

[22] Filed: Mar. 10, 1978

[51] Int. Cl.[2] ..... F21L 7/00

[52] U.S. Cl. ..... 362/202; 40/555; 46/228; 362/102; 362/806

[58] Field of Search ..... 362/103, 32, 120, 252, 362/806, 810, 811, 102, 202; 46/228, 227, 229; 40/555, 563; 313/113

[56] References Cited

U.S. PATENT DOCUMENTS

| | | | |
|---|---|---|---|
| 2,245,349 | 6/1941 | Lombardi | 362/102 |
| 2,362,131 | 11/1944 | Haggart, Jr. | 362/102 |
| 2,481,757 | 9/1949 | Jungersen | 350/103 |
| 2,486,998 | 11/1949 | Szeklinski | 362/102 |
| 3,174,688 | 3/1965 | Chatten | 40/563 X |
| 3,184,366 | 5/1965 | Claude | 362/807 |
| 3,877,171 | 4/1975 | Sloop | 46/228 |

FOREIGN PATENT DOCUMENTS

| | | | |
|---|---|---|---|
| 1515967 | 5/1968 | France | 362/102 |

*Primary Examiner*—Harold J. Tudor
*Attorney, Agent, or Firm*—Warren, Chickering & Grunewald

[57] ABSTRACT

A luminous toy, including a light source and an elongated hollow member formed of translucent material extending therefrom for receiving light longitudinally through the member, and an elongated sinuous strip of light-reflecting material mounted interiorly of the member in position for receiving and reflecting light from the source.

5 Claims, 4 Drawing Figures

LUMINOUS TOY

BACKGROUND OF THE INVENTION

The invention relates to toys having luminous parts and, particularly, to those having a luminous staff, as for example, see U.S. Pat. No. 2,245,349. Other prior art having structure of a nature somewhat similar to that used in the present device are luminous batons, such as used for directing traffic and the like, see for example, U.S. Pat. Nos. 2,362,131 and 2,486,998.

SUMMARY OF THE INVENTION

An object of the present invention is to provide a novel, durable plaything for children simulating magic ray devices as may appear in motion pictures and television space adventure stories, and stimulating the interest of young people in and furnishing an important theatrical prop in enacting games and fantasies relating to space travel and adventure.

Another object of the present invention is to provide a toy of the character described which will be attractive and instinctively and safely used and enjoyed by children in their play and which will provide improved luminosity and realism in the simulation of certain space-age ray devices.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

Figure 1:
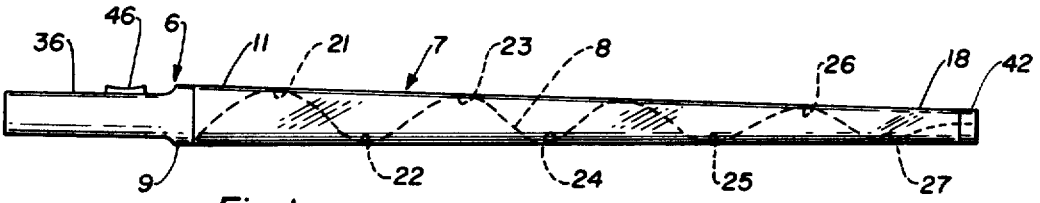
FIG. 1 is a side elevation of a luminous toy constructed in accordance with the present invention.
Figure 2:
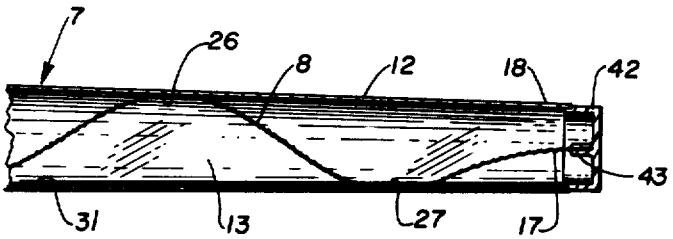
FIG. 2 is a fragmentary cross-sectional view on an enlarged scale of one portion of the toy.
Figure 3:
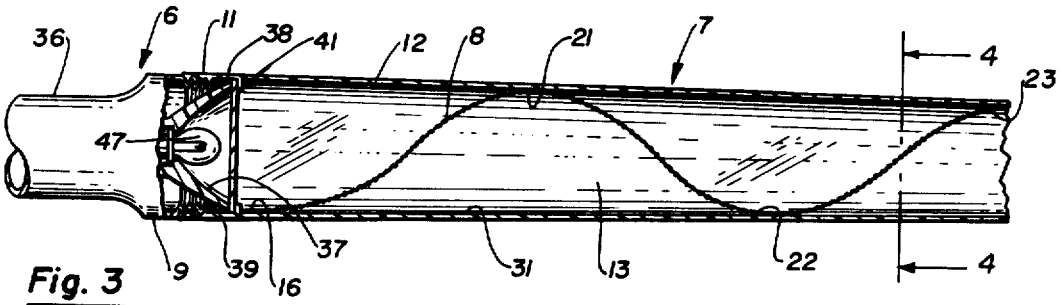
FIG. 3 is a fragmentary side elevation and cross section on an enlarged scale of another portion of the toy.
Figure 4:
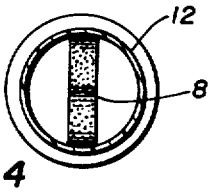
FIG. 4 is a cross-sectional view of the toy taken substantially on the plane of line 4—4 of FIG. 3.

The luminous toy of the present invention comprises, briefly, a light source 6; an elongated hollow member 7 having an annular wall 12 formed of translucent material and connected at one end 9 of the light source for transmission of light longitudinally through the member; and an elongated sinuous strip 8 of light-reflecting material mounted interiorly of member 7 in position for receiving and reflecting light from source 6. Importantly, strip 8 has at least one substantially complete and substantially wall-to-wall cyclic undulation whereby incident light rays from source 6 will be reflected at a multiplicity of angles through side wall 12. Preferably, as shown in FIG. 1, strip 8 has a plurality of such complete wall-to-wall cyclic undulations for optimum light radiation over the length of member 7. Preferably, member 7 is of conical shape, having its larger normally proximal end 11 connected to the light source and its annular side wall 12 defining an elongated hollow chamber 13 therein, and strip 8 is mounted in chamber 13 and has its opposite ends 16 and 17 secured to member 7 adjacent its opposite ends 11 and 18 and having sinuous portions 21, 22, 23, 24, 25, 26 and 27 supported on the interior surface 31 of side wall 12 at spaced position along the length of chamber 13. As a feature of the present construction, strip 8 is formed of a length of translucent plastic material, as cut from a thin flexible plastic sheet, and is coated on both sides with metallic light-reflecting particles. Strip 8 is narrower than the diameter of wall 12, thus permitting light rays to travel both through the translucent strip, as well as alongside of the strip. Accordingly, light rays traveling lengthwise of chamber 13 impinge on a variegated reflective surface provided by member 8, thus reflecting light rays laterally at all angles out through the translucent side wall 12. Strip 8 may be fabricated from mylar sheet stock with the reflective particles applied to its opposite sides by a suitable glue or adhesive.

Light source 6 may be provided by a conventional flashlight construction having a tubular battery-receiving housing 36 providing a rigid handle for the toy and having its end 9 externally threaded for threadable engagement with interior threads formed on the larger end 11 of the translucent member. A customary parabolic light reflector 37 is mounted internally within housing 36, with its axis co-incident with the axis of chamber 13 and having its outer rim 38 extending to adjacent the distal end 39 of housing 36; and the larger end 11 of member 7 is here formed with an internal flange 41 confining the reflector rim between the flange and housing end 39.

The opposite smaller end 18 of member 7 may be closed by an end cap 42 inserted and secured within end 18. Preferably, this cap is quite blunt in shape and may be fabricated of a relatively soft plastic, such as flexible PVC, the latter also being a preferred material for member 7. End cap 42 is here formed with an internally and centrally extending tongue 43, which may be formed with a slit in which the end 17 of strip 8 may be inserted and secured. The opposite end 16 of the strip may be adhesively secured to wall surface 31, although, due to the sinuous shape of the strip, it is quite self-supporting within chamber 13.

Light source 6 may comprise a conventional flashlight construction including a battery-receiving housing 36, reflector 37, a manually operated switch 46 controlling the operation of light bulb 47 mounted within reflector 37.

What is claimed is:

1. A luminous toy comprising:

a light source;

an elongated hollow member having a translucent side wall connected at one end to said light source for transmission of light longitudinally through said member; and an elongated sinuous strip of light-reflecting material mounted interiorly and longitudinally of said member and having at least one substantially complete and substantially wall-to-wall cyclic undulation whereby incident light rays from said source will be reflected at a multiplicity of angles through said side wall.

2. The toy of claim 1, said strip having a plurality of said cyclic undulations.

3. The device of claim 2, said strip comprising a length of translucent plastic material having metallic light-reflecting particles thereon.

4. The toy of claim 3, said member being of conical shape having its larger normally proximal end connected to said source; and a plug mounted in and closing the smaller normally distal end of said member, said plug having in internally projecting tongue securing the distal end of said strip.

5. The device of claim 4, said light source having a tubular battery-receiving housing providing a rigid handle for said toy and having an externally threaded end, and a parabolic light reflector mounted internally of said housing with its axis co-incident with the axis of said chamber and having an outer rim extending to adjacent said housing end; and the larger end of said member being internally threaded for threaded connection to said housing end and having an internal flange confining said reflector rim between said flange and housing end.

* * * * *